US007014598B2

(12) United States Patent
Fenelon et al.

(10) Patent No.: US 7,014,598 B2
(45) Date of Patent: Mar. 21, 2006

(54) BALANCED STACKABLE DUMBBELL SYSTEM

(75) Inventors: Paul J. Fenelon, 13 Inverary, Nashville, TN (US) 37215; Lawrence Morgan, Nashville, TN (US); Michael P. Sohr, Nashville, TN (US)

(73) Assignee: Paul J. Fenelon, Nashville, TN (US)

( * ) Notice: Subject to any disclaimer, the term of this patent is extended or adjusted under 35 U.S.C. 154(b) by 541 days.

(21) Appl. No.: 10/203,689

(22) PCT Filed: Feb. 9, 2001

(86) PCT No.: PCT/US01/04239

§ 371 (c)(1),
(2), (4) Date: Dec. 2, 2002

(87) PCT Pub. No.: WO01/58533

PCT Pub. Date: Aug. 16, 2001

(65) Prior Publication Data

US 2003/0207740 A1 Nov. 6, 2003

Related U.S. Application Data

(63) Continuation-in-part of application No. 09/501,392, filed on Feb. 9, 2000, now Pat. No. 6,461,282.

(60) Provisional application No. 60/214,919, filed on Jun. 29, 2000.

(51) Int. Cl.
*A63B 21/072* (2006.01)

(52) U.S. Cl. ..... 482/107; 482/106; 482/108

(58) Field of Classification Search ..... 482/106–108, 482/98, 104, 94, 109
See application file for complete search history.

(56) References Cited

U.S. PATENT DOCUMENTS

| | | | |
|---|---|---|---|
| 660,962 | A | 10/1900 | Kennedy |
| D200,053 | S | 1/1965 | Edwards |
| D244,628 | S | 6/1977 | Wright |
| 4,029,312 | A | 6/1977 | Wright |
| D271,407 | S | 11/1983 | Wright |
| D274,283 | S | 6/1984 | Wright |
| D302,195 | S | 7/1989 | Orak |
| 4,854,575 | A | 8/1989 | Wilson et al. |
| 4,900,017 | A | 2/1990 | Bold, Jr. |
| D307,168 | S | 4/1990 | Vodhanel |
| D343,660 | S | 1/1994 | Hwang |
| 5,421,797 | A | 6/1995 | Fletcher |
| D372,945 | S | 8/1996 | Morgan |

(Continued)

OTHER PUBLICATIONS

International Search Report, PCT/US01/04239, ISA/US, Sep. 30, 2001.

(Continued)

*Primary Examiner*—Stephen R. Crow
(74) *Attorney, Agent, or Firm*—Harness, Dickey & Pierce, P.L.C.

(57) ABSTRACT

A dumbbell system (10) is provided including a base weight member (12) having a ring-shaped body (14) and a handle (18) extending across an opening (16) in the ring-shaped body (14). A plurality of weight rings (20, 22, 24) are adapted to be removably mounted to the base weight member (12) in order to provide a compact dumbbell system which has the capability of providing several weight increments in a compact assembly. The dumbbell system (10) is ideal for use in areas where space is limited. The dumbbell (10) also provides for a unique balanced mass arrangement which alleviates undesired stresses on a user's wrist.

6 Claims, 14 Drawing Sheets

U.S. PATENT DOCUMENTS

| | | | | |
|---|---|---|---|---|
| 5,607,379 | A | 3/1997 | Scott | |
| 5,637,064 | A | 6/1997 | Olson et al. | |
| 5,779,604 | A | 7/1998 | Towley, III et al. | |
| 6,083,144 | A | 7/2000 | Towley, III et al. | |
| 6,500,101 | B1 * | 12/2002 | Chen | 482/107 |
| 6,896,645 | B1 * | 5/2005 | Krull | 482/107 |

OTHER PUBLICATIONS

*Body Online Trends*, ProBell "Adjustable Dumbbell System" (website http://www.bodytrends.com/pbl.htm) (27 pages).

*Powerblock*, "World's Best Dumbbell!"(2 pages).

* cited by examiner

FIG 1
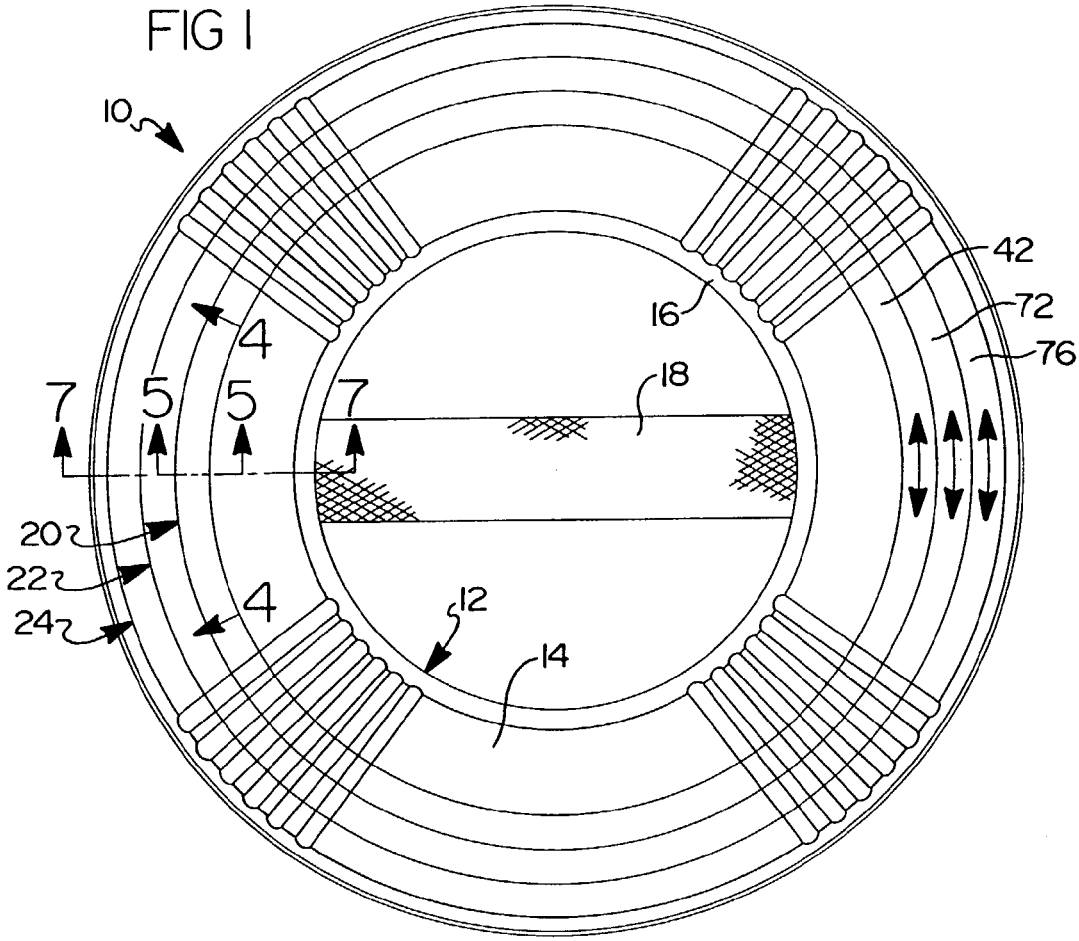
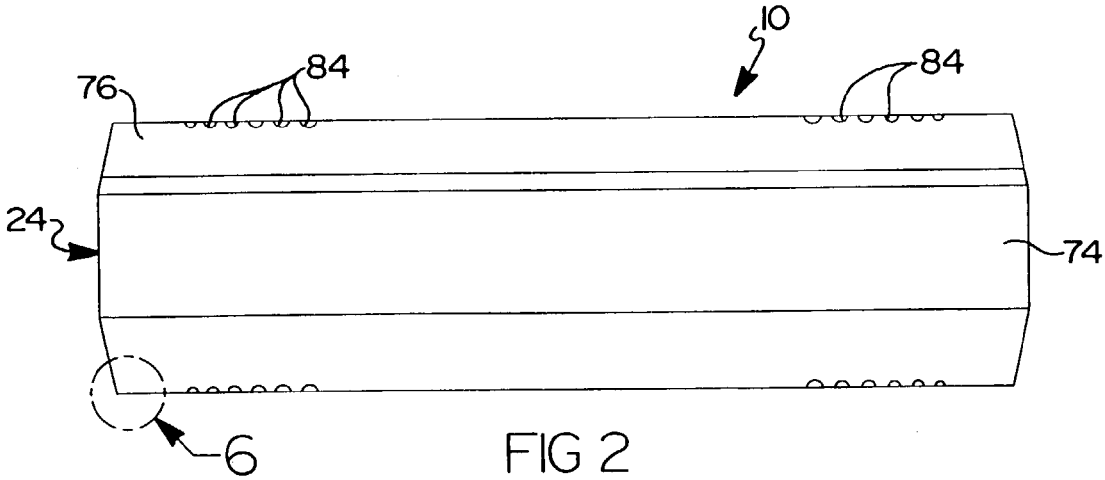
FIG 2

FIG 7
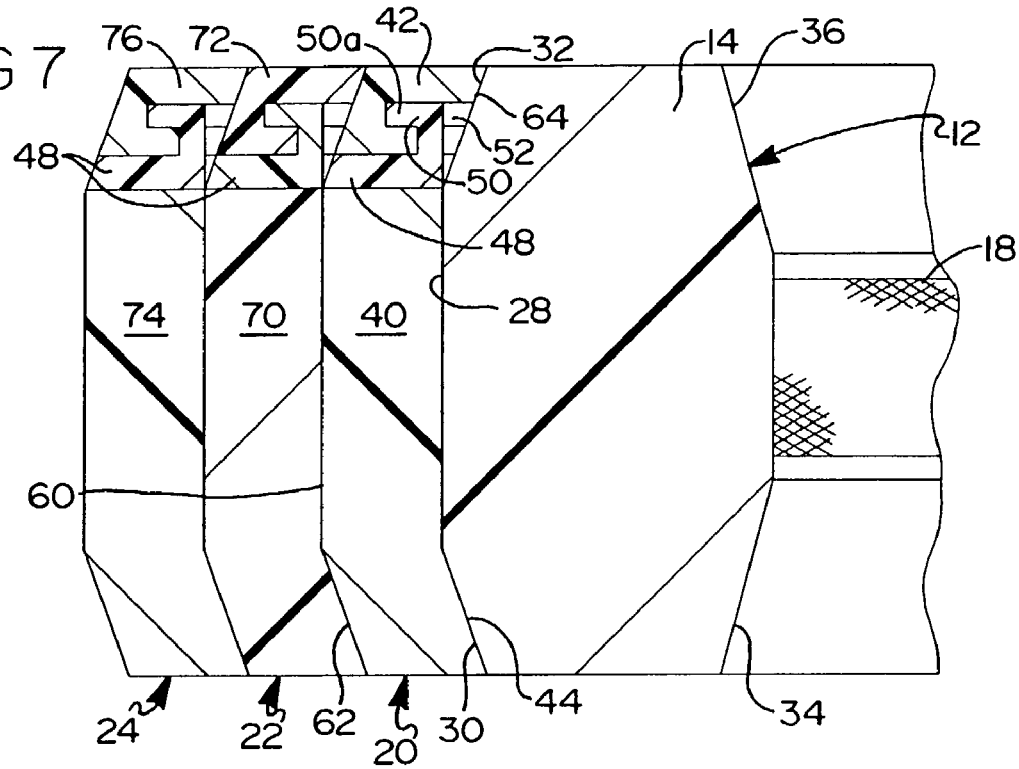
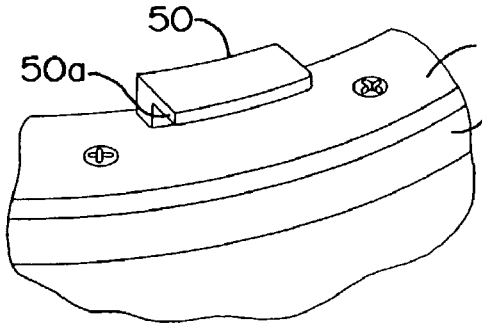
FIG 9
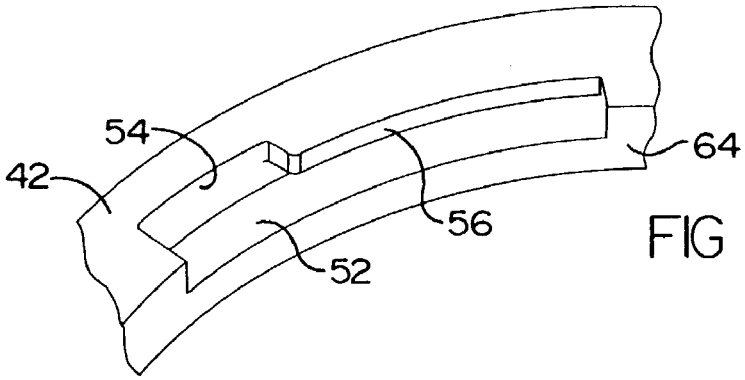
FIG 8

FIG 10
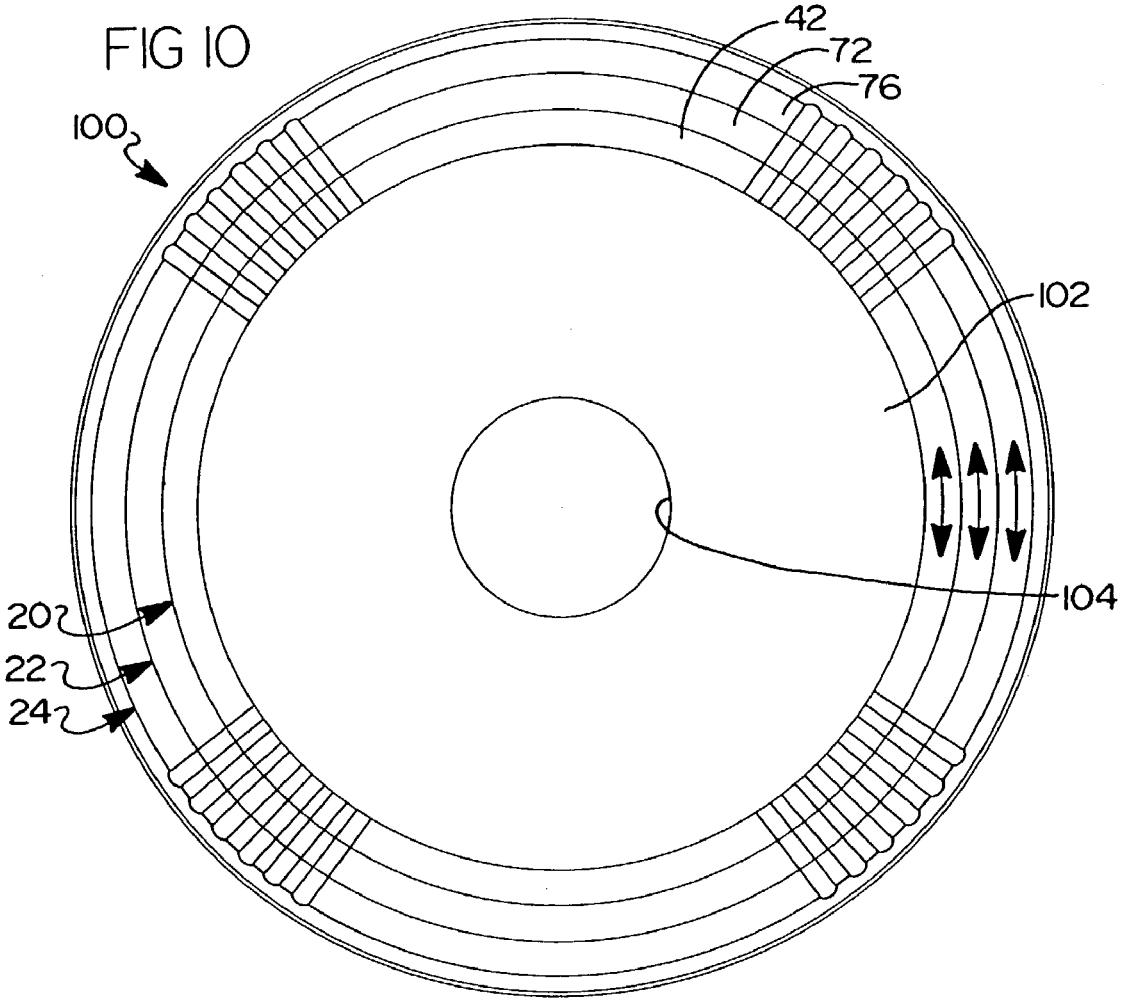
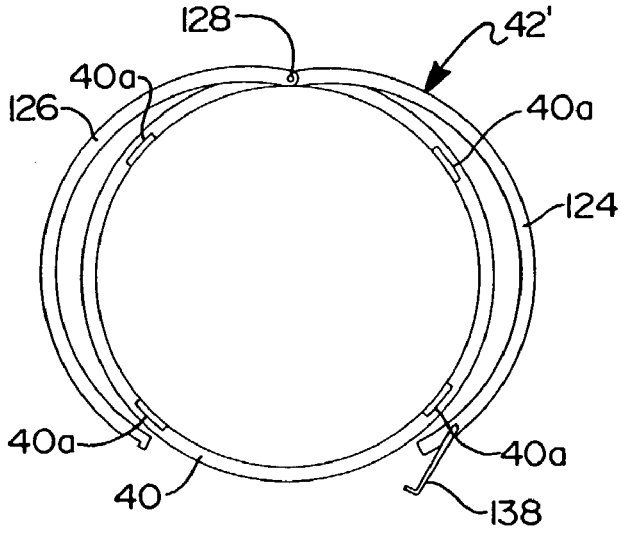
FIG 17a

FIG 14
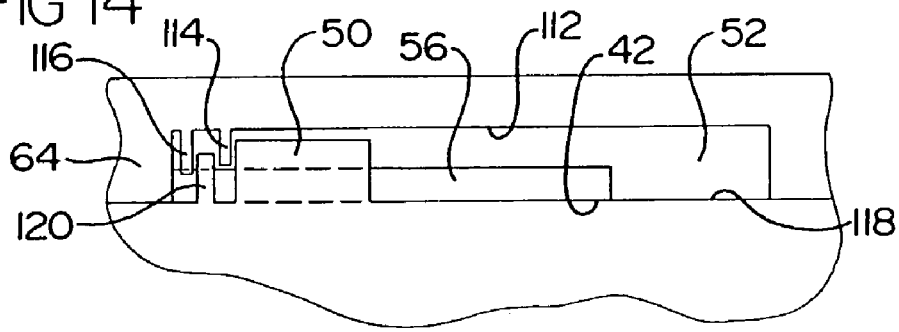
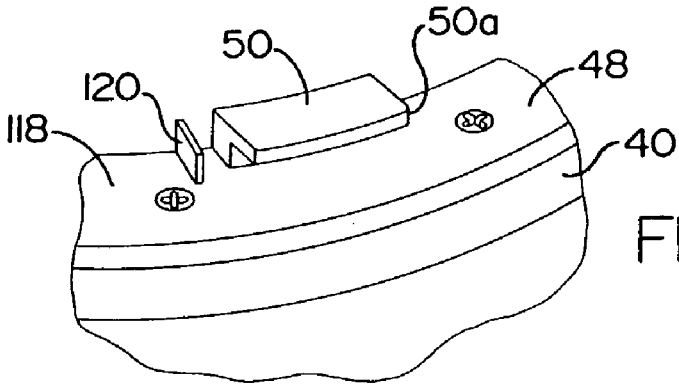
FIG 15
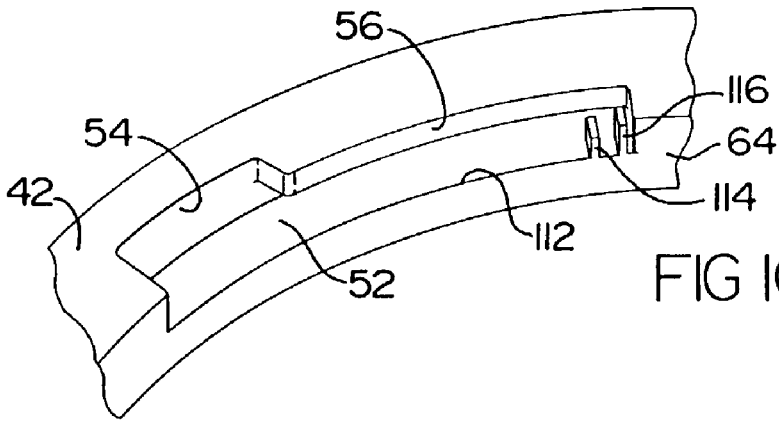
FIG 16

FIG 17
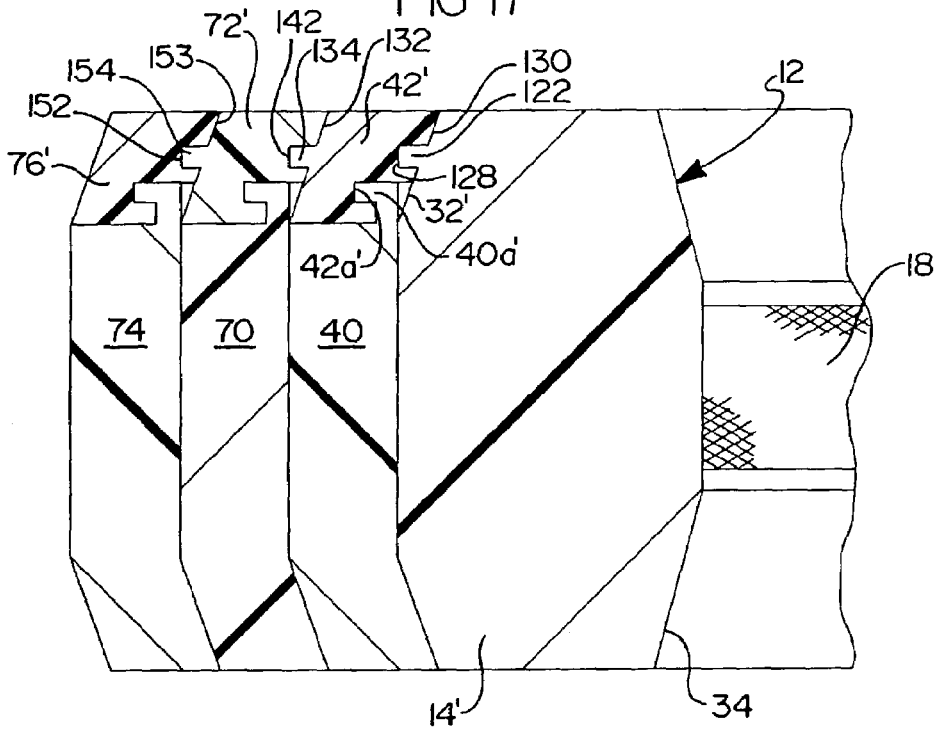
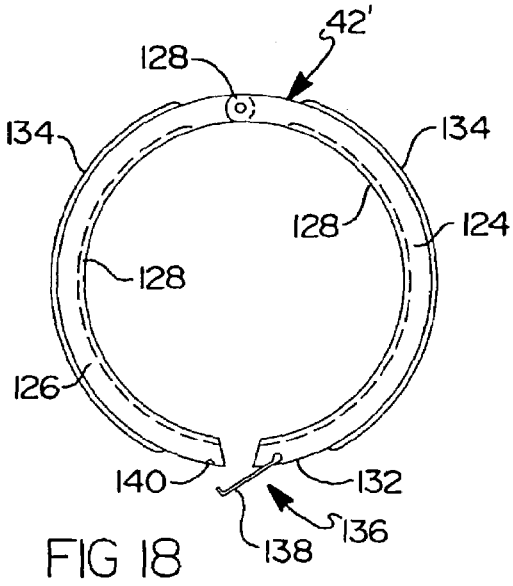
FIG 18
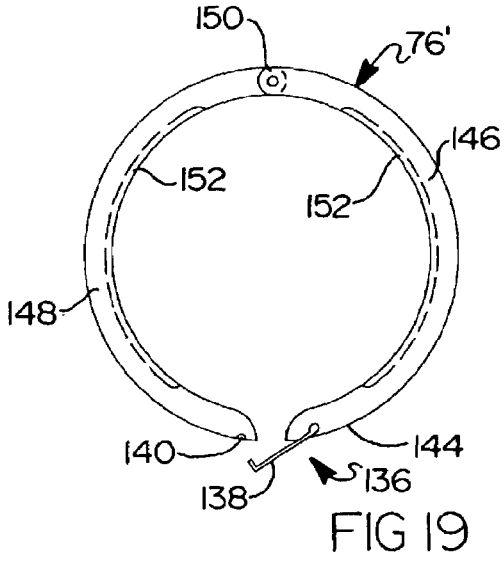
FIG 19

FIG 20
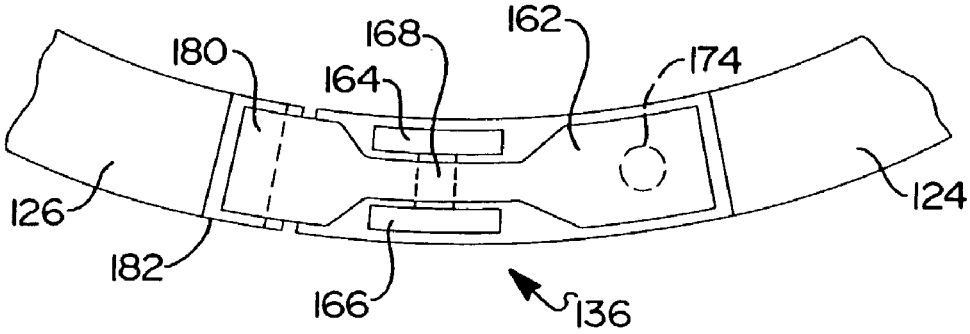
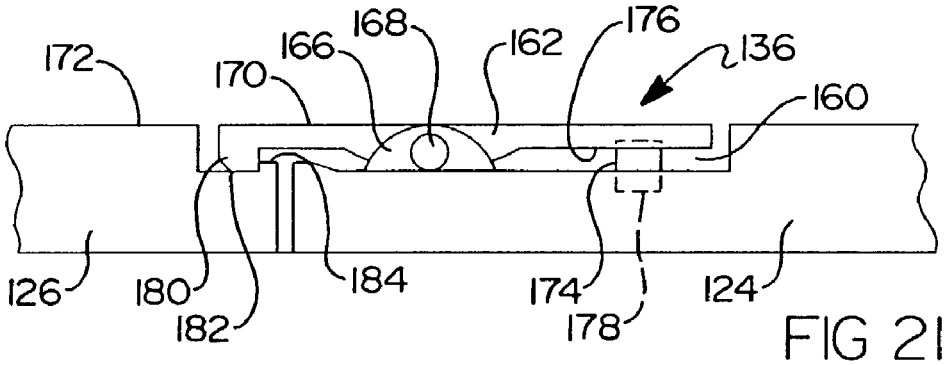
FIG 21
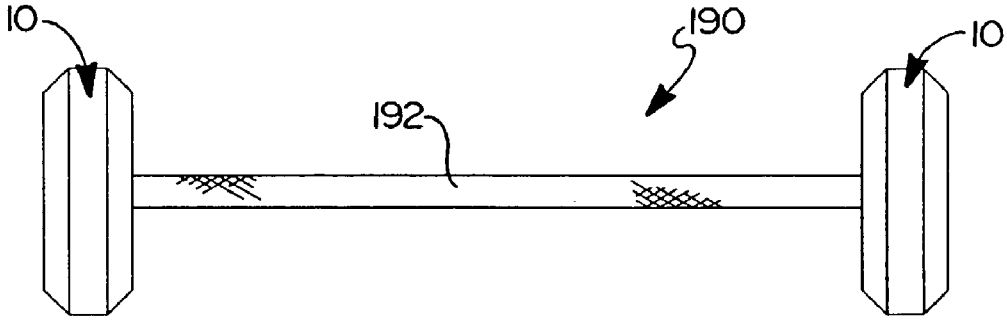
FIG 22

FIG 26
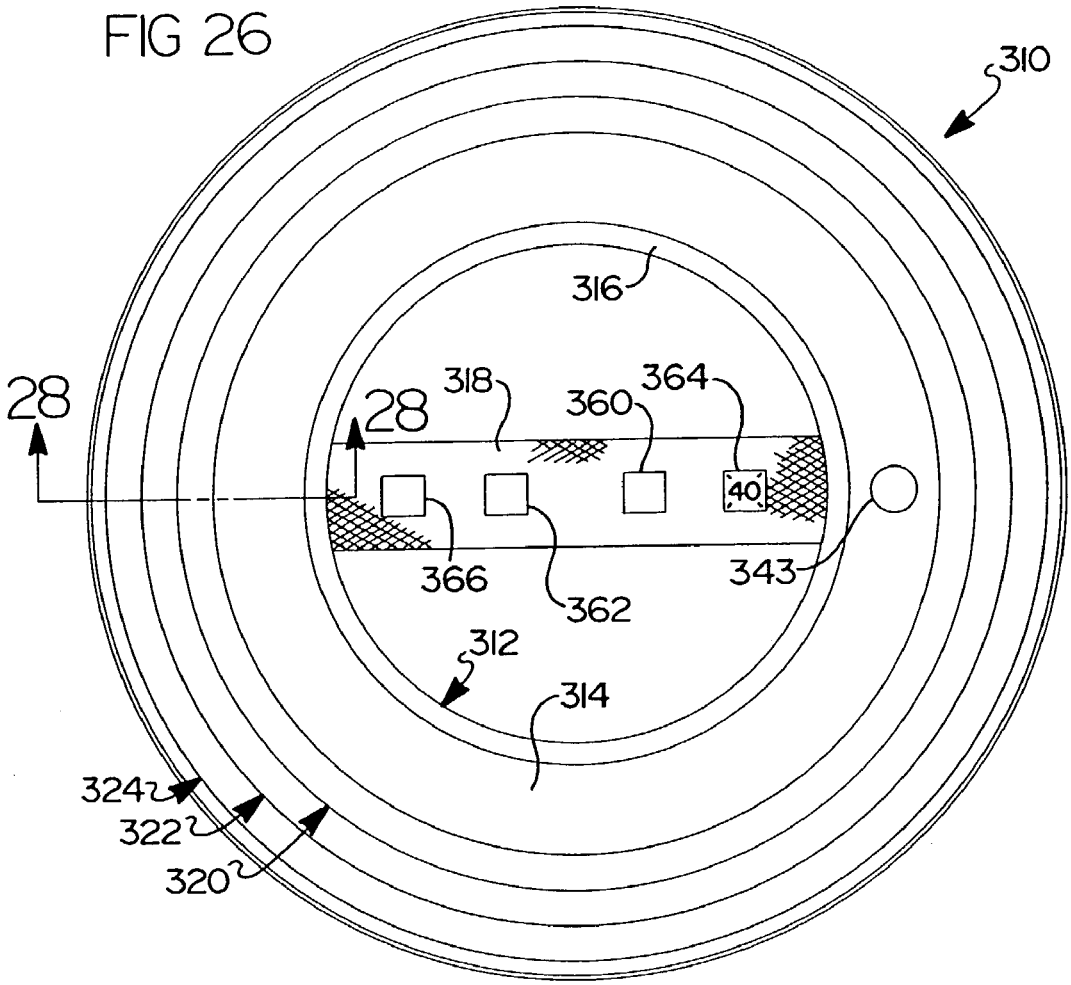
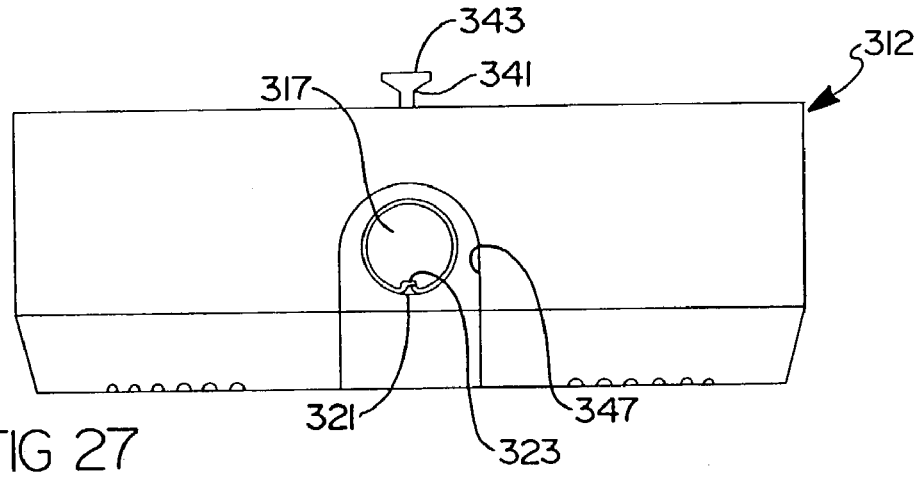
FIG 27

BALANCED STACKABLE DUMBBELL SYSTEM

This Application is a continuation-in-part of Provisional U.S. Application No. 60/214,919 filed on Jun. 29, 2000, which is a continuation-in-part of U.S. application Ser. No. 09/501,392 filed on Feb. 9, 2000 now U.S. Pat. No. 6,461, 282.

FIELD OF THE INVENTION

The present invention relates generally to dumbbells for weight lifting, and more particularly to a dumbbell system with improved ergonomic design and which allows for the simple addition of additional weights to a base dumbbell member in a compact design.

BACKGROUND

Studies have shown that exercise greatly reduces the risk of heart disease and other ailments, and also contributes to better overall health and well being. Weight lifting has been determined to be a very important part of a well balanced exercise regimen. Accordingly, people are joining health clubs and purchasing home gym equipment in order to improve their physical fitness.

Health clubs typically have several racks of non-stackable dumbbells of varying weight which range from five pounds to approximately 120 pounds in five-pound or similar increments. The racks to hold all of the dumbbells in the five-pound to 120-pound sets are typically several feet long. Because such sets of dumbbells are extremely expensive and consume a lot of space, these sets are not well designed for home use.

Dumbbells have been designed for home gym use to include a bar having a center sleeve portion which defines a handle and weight discs which are removably attached to each end of the bar by a locking collar. A problem with these prior art designs is that it is still necessary to maintain a full set of disc weights which can be placed on the ends of the dumbbell bar. Furthermore, it is time consuming to put the weights on and take the weights off from this type of dumbbell design. The locking collars are also a safety hazard if they are not properly secured in place. In addition, with the weights being disposed at each end of the dumbbell, the moment arm which is applied to a user's wrist if the dumbbell is not maintained in a horizontal plane can result in painful stresses to the wrist joint of the user. Similar painful stresses are present with standard one-piece dumbbells.

SUMMARY OF THE INVENTION

Accordingly, it is an object of the present invention to provide a dumbbell system which is capable of providing several increments of weight in a compact construction.

It is another object of the present invention to provide a dumbbell system which provides equally distributed weight around the handle of the dumbbell assembly so that rotation of the handle away from a horizontal position does not result in undesirable added stresses on the user's wrist.

It is yet another object of the present invention to enable a user to attach a pair of dumbbells to a bar for use as a barbell. As a result the barbell maintains the incremental weight/compact construction advantages of the individual dumbbells.

These and other objects of the present invention are obtained by providing a dumbbell system including a base weight member including a ring shaped body and a handle extending across an opening in the ring shaped body. A weight ring is adapted to be removably mounted to the base weight member. According to a first embodiment, a lock ring is engageable with the weight ring to securely mount the weight ring to the base weight member. The weight ring includes a first mating portion, and the lock ring includes a second mating portion which is adapted to be engaged with the first mating portion of the weight ring for securing the weight ring to the lock ring. The base weight member has an outer perimeter surface with a pair of angularly disposed edge portions while the weight ring includes an inner surface with at least one angularly disposed edge portion which engages one of the pair of angularly disposed edge portions of the base weight member. The locking ring includes an angularly disposed inner surface which engages the other of the pair of angularly disposed edge portions of the base weight member.

A series of additional weight rings are adapted to be removably mounted to one another in order to provide variable increments of weight. The base weight member as well as the additional weight rings can be nested together in a single assembly and the lock rings can be selectively engaged or disengaged from the weight rings in order to allow the user to select from a plurality of weight increments. The lock rings can be provided with a plurality of dimples on a face surface thereof in order to facilitate rotation of the lock ring relative to the corresponding weight ring so that the lock ring can be easily engaged or disengaged from the weight ring.

According to another embodiment, a threaded screw system is actuated to selectively engage and disengage additional weight rings to the base weight member. Preferably, the threaded screw system is driven by rotation of the handle of the base weight member.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein:

FIG. 1 is a top view of a dumbbell assembly according to the principles of the present invention;

FIG. 2 is a side view of the dumbbell assembly shown in FIG. 1;

FIG. 7 is a cross-sectional view along line 7—7 of FIG. 1;

FIG. 8 is a detailed perspective view of the slot provided in the lock rings according to the principles of the present invention;

FIG. 9 is a detailed perspective view of the locking tabs which are engageable with the slot in the lock ring;

FIG. 10 is a top view of a weight disk system according to the principles of the present invention;

FIG. 14 is a modified view of FIG. 4 illustrating an acoustic lock signal mechanism for the locking ring according to the principles of the present invention;

FIG. 15 is a modified view of FIG. 9 illustrating an engagement tab of the acoustic lock signal mechanism;

FIG. 16 is a modified view of FIG. 9 illustrating retaining tabs of the acoustic lock signal mechanism;

FIG. 17 is a modified view of FIG. 7 illustrating a second preferred embodiment of a locking ring according to the principles of the present invention;

FIG. 17*a* is a top view of the second preferred embodiment of the locking ring with a weight ring according to the principles of the present invention;

FIG. 18 is a top view of the second preferred embodiment of the locking ring implementing a first preferred embodiment of a latching mechanism according to the principles of the present invention;

FIG. 19 is a top view of the second preferred embodiment of the locking ring implementing a second preferred embodiment of a latching mechanism according to the principles of the present invention;

FIG. 20 is a top view of the second preferred embodiment of the latching mechanism;

FIG. 21 is a side view of the second preferred embodiment of the latching mechanism;

FIG. 22 is a schematic view of a barbell assembly according to the principles of the present invention;

FIG. 26 is a top view of the dumbbell assembly shown in FIG. 25;

FIG. 27 is a side view of the base weight member of the dumbbell assembly shown in FIG. 25.

DETAILED DESCRIPTION OF THE PREFERRED EMBODIMENTS

Figure 3:
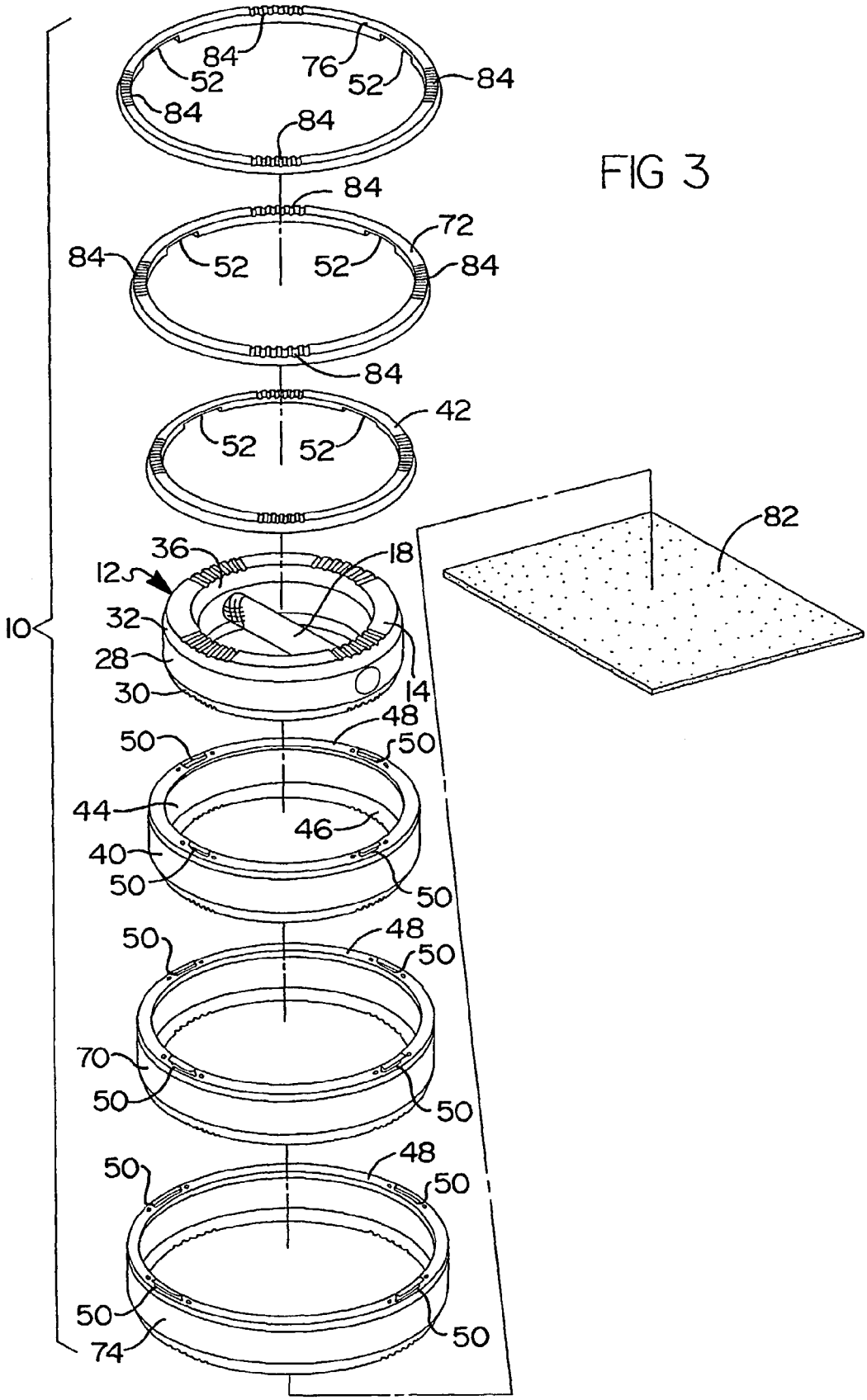
FIG. 3 is an exploded perspective view of the dumbbell assembly according to the principles of the present invention.
Figure 4:
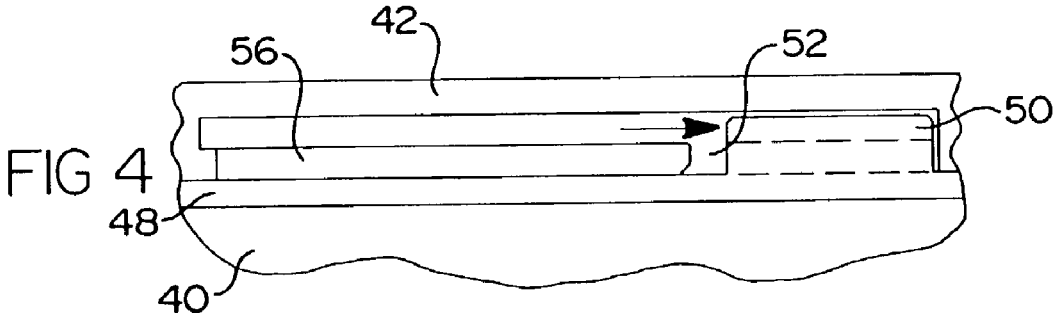
FIG. 4 is a detailed view taken along line 4—4 of FIG. 1 illustrating the insertion of the locking tab into the slot of the locking ring according to the principles of the present invention.

With reference to the accompanying drawings, a dumbbell assembly 10 of the present invention will now be described. The dumbbell assembly 10 includes a base weight member 12 including a body portion 14 defining a central opening 16 extending therethrough and including a handle 18 which extends across the opening 16 in the body portion 14. According to a preferred embodiment, the body portion 14 is ring shaped. A first weight ring assembly 20 is removably mounted to the base weight member 12. A second weight ring assembly 22 is adapted to be removably mounted to the first weight ring 20. A third weight ring assembly 24 is adapted to be removably mounted to the second weight ring assembly 22.

As mentioned above, the body portion 14 of the base weight member 12 is preferably ring shaped. As best shown in the cross-sectional view of FIG. 7, the body portion 14 of the base weight member 12 includes an outer perimeter surface 28 with a pair of angularly disposed edge portions 30, 32. The angularly disposed edge portions 30, 32 extend radially inward. It should also be noted that the inner perimeter surface of the body portion 14 is also provided with angularly disposed edge portions 34, 36 which extend radially outward. The angularly disposed edge portions 34, 36, which are disposed on the inner perimeter surface of the body portion 14 allow for easier access of a user's hand and helps to avoid interference with a user's wrist or forearm while the dumbbell assembly 10 is in use. Additionally, the angularly disposed edge portions 34, 36 allow for a reduction of the inner diameter opening of the handle 18, hence reducing the overall size of the dumbbell assembly 10 and hence, also reduces the torque moments over a standard cylindrical weight.

Figure 11:
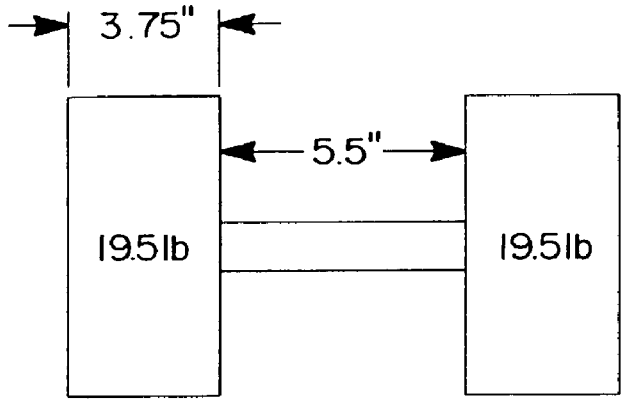
FIG. 11 is a schematic view of a standard 40 pound dumbbell for purposes of illustrating the moment forces.
Figure 12:
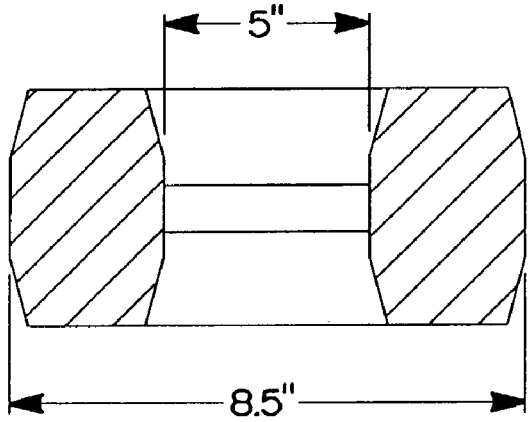
FIG. 12 is a cross sectional view of a 40 pound dumbbell having angled interior edges according to the present invention for purposes of illustrating the moment forces.
Figure 13:
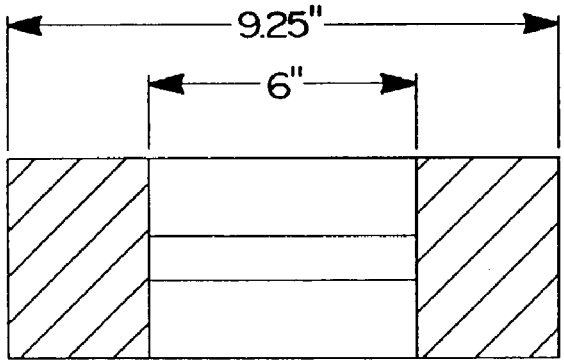
FIG. 13 is a cross sectional view of a ring shaped 40 pound dumbbell for purposes of illustrating the moment forces.

A standard dumbbell free weight is comprised of two equal weights, typically hexagonal in shape, attached and separated by a cylindrical handle 5.0 to 5.5 inches long. If a fulcrum is placed at the center of the handle, then the dumbbell is balanced like a see-saw and equal and opposite torques, i.e. moment×weight, are applied at both ends of the dumbbell. These torques for a typical 40-lb. weight are 90.2 inch-lbs. (see FIG. 11 and Equation [1] below). If the same 40 lb. free weight is made with a cylindrical configuration which includes angled edges within the gripping opening, then the left and right side torques calculate to be 32 in-lbs. (see FIG. 12 and Equation [2] below). That is approximately 35% of a standard dumbbell. If on the other hand the cylindrical 40 lb. free weight is made from a cylinder of equal height with no angled edges, then the torques at the left and right hand sides calculate to be 37 in-lbs. (see FIG. 13 and Equation [3] below). That is 41% of a standard dumbbell but 15% greater than the cylindrical weight with angled edges within the gripping opening. The equations for each of the above calculations is shown below.

$$\text{torque}=19.5\times(5.5/2+3.75/2)=90\ \text{inch-lbs.} \quad [1]$$

$$\text{torque}=39/4\times3.375=32.1\ \text{inch-lbs} \quad [2]$$

$$\text{torque}=39/4\times3.8125=37.2\ \text{inch-lbs.} \quad [3]$$

Figure 5:
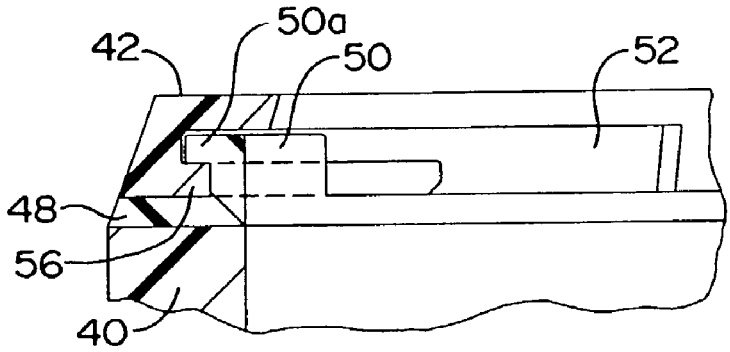
FIG. 5 is a cross-sectional view taken along line 5—5 of FIG. 1 illustrating the locking tab engaged with the slot of the lock ring according to the principles of the present invention.

The base weight member 12 can be nested with a plurality of weight rings such as weight ring assemblies 20, 22, 24. The first weight ring assembly 20 includes first weight ring 40 and first lock ring 42. The first weight ring 40 includes an inner surface 44 with an angularly disposed edge portion 46 which extends radially inward and corresponds with the angularly disposed edge portion 30 of the base weight member 12. The first weight ring 40 also includes a mounting ring 48 fixedly attached to a body portion of the weight ring 40. The mounting ring 48 includes a plurality of mating portions 50 in the form of locking tabs. The lock ring 42 includes a plurality of corresponding mating portions in the form of slots 52. The locking tabs 50 extend vertically upward from the mounting ring 48 and have an uppermost portion 50*a* which extend radially outward as best shown in FIGS. 5, 7, and 9. The slots 52 disposed in the lock ring 42 include a first recess portion 54 which is adapted to receive the radially outward extending portion 50*a* of the tab 50. The slot 52 also includes a flange portion 56 which, upon rotation of the lock ring 42 relative to the weight ring 40, receives the radially outwardly extending portion 50*a* of the locking tabs 50 as shown in FIG. 5 in order to engage the lock ring 42 to the first weight ring 40.

The first weight ring 40 also includes an outer perimeter surface 60 with an angularly disposed lower edge portion 62. The lock ring 42 includes an angularly disposed outer surface 63 and an angularly disposed inner surface 64 which engages the upper angularly disposed edge portion 32 of the base weight member 14. The angularly disposed edge portions 30, 32 of the base weight and the angularly disposed lower edge portions of the weight rings and the angularly disposed surfaces of the lock ring are preferably greater than approximately 7 degrees to avoid locking or wedging of the elements together. The larger the angle, the easier the elements go together and come apart. An angle of 20 degrees has been found to effectively satisfy manufacturing anti-locking characteristics.

The second and third weight ring assemblies 22, 24 are identical in design to the first weight ring assembly 20 but are simply larger in size such that the first weight ring assembly can be nested inside the second weight ring assembly and the second weight ring assembly 22 can be nested radially inward of the third weight ring assembly 24. Specifically, the second weight ring assembly 22 includes a second weight ring 70 and a second lock ring 72 and the third weight ring assembly 24 includes a third weight ring 74 and a third lock ring 76. Each of the weight ring assemblies 20, 22, 24 is designed with a sufficient tolerance to allow mating with one another to prevent locking.

The second and third weight rings 70, 74 each include a mounting ring 48 with tabs 50 as described above with respect to the first weight ring 40. The mounting rings 48 are mounted to the body of the first, second, and third weight rings 40, 70, 74 by screws or by other fastening techniques such as adhesives. The mounting rings 48 are preferably made of injection molded plastic while the body portion of the first, second, and third weight rings 40, 70, 74 are preferably made of cast metal, although other materials exhibiting the desired weight characteristics can also be utilized. The second and third lock rings 72, 76 are also provided with slots 52 similar to the slots 52 provided in the first lock ring 42. The first, second, and third lock rings 42, 72, and 76 are preferably made of a plastic material. The use of a combination of materials as discussed above allows for several advantages. Since the plastic components can be made with high precision and the cast metal components can be made at low cost, the assembly as a whole can be manufactured at low cost while the use of the plastic components (mounting rings and lock rings) allows the assembly to be manufactured with high tolerance so as to have a refined operation and appearance.

It is also foreseen that the first, second and third locking rings can include an acoustic lock signal mechanism. In operation, once a locking ring has been sufficiently rotated to its lock position, a "click" can be heard signaling to a user that the locking ring is indeed locked. With reference to FIGS. 14 through 16, a preferred embodiment of an acoustic lock signal mechanism 110 will be described in detail. The acoustic lock signal mechanism 110 is disposed within at least one of the slots 52. Specifically, the acoustic lock signal mechanism 110 is disposed on a first end of the slot 52, located opposite to the recess portion 54. A top surface 112 of the slot has first and second fingers 114,116. The first finger 114 is shorter than the second finger 116. A top surface 118 of the mounting ring 48 includes a third finger 120 extending upward and located next to the tab 50. The locking ring 42 and mounting ring 48 are engaged as previously described. However, as the locking ring is rotated towards its lock position the upward extending third finger 120 contacts the downward hanging first finger 114. With sufficient force, the upward extending third finger 120 flexes to pass under the downward hanging first finger 114. Once the third finger 120 passes under the first finger 114 it snaps back into position, contacting the second finger 116. As this process occurs, a "clicking" sound results, thus signaling the operator that the locking ring 42 is locked.

In operation, the dumbbell assembly 10, according to the principles of the present invention, is laid out in the manner shown in FIG. 1. As is well understood, a pair of dumbbell assemblies 10 is often used during a workout. Initially, it should be noted that the base weight members 12 can be provided with a selected amount of weight such as, for example, 15 pounds or 20 pounds. Then, each of the weight ring assemblies 20, 22, 24 can weigh, for example, 10 pounds so that the base weight member 12 used alone can provide, for example, a 15-pound or 20-pound weight while the addition of the first weight ring assembly 20 will allow the use of a 25-pound and 30-pound dumbbell, and the addition of the first and second weight ring assemblies 20, 22 will provide a 35-pound and 40-pound dumbbell and the use of the first, second, and third weight ring assemblies 20, 22 and 24 would provide a 45-pound and 50-pound dumbbell. The base weight members of 10, 15 or 20 pounds are designed so that their outer perimeters are identical and can readily accept the weight ring assemblies 20, 22 and 24.

By selectively disengaging the third lock ring 76 from the third weight ring 74, the dumbbell assembly 10 can be picked up by handle 18 and the first and second weight ring assemblies 20, 22 would be picked up along with the base weight member 12 while the third weight ring 74 would remain on the floor. Similarly, removal of the second and third lock ring 72, 76 from the second and third weight rings 70, 74 by rotation of the lock rings in the direction of arrow B would allow the first weight ring assembly 20 to be maintained with the base weight member 12 but freed from the second and third weight ring assemblies 22, 24. In addition, removal of all of the lock rings 42, 72, 76 would allow the base weight members 12 to be utilized alone in order to provide the smallest increment of weight for the dumbbell assembly 10.

Figure 6:
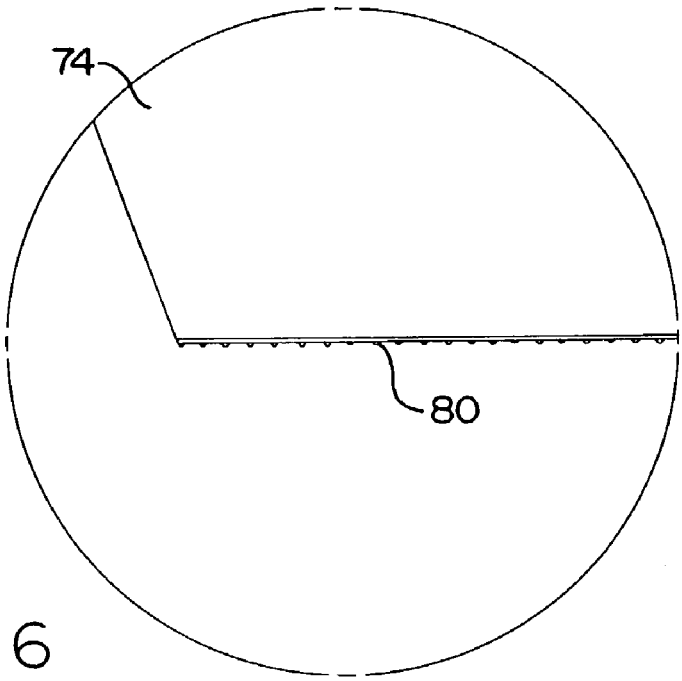
FIG. 6 is a detailed view of the circled area 6 of FIG. 2 illustrating the serrations on the face surface of the dumbbell system of the present invention.

In order to facilitate holding the first, second, or third weight rings 40, 70, 74 from rotating with the rotation of the corresponding lock ring 42, 72, 76, the bottom face surfaces of the first, second, and third weight rings 40, 70, 74 can be provided with a serrated surface 80 such as shown in FIG. 6. The serrations would act to provide a frictional contact with the floor to prevent the weight rings from rotating when the lock rings are engaged or disengaged. Alternatively, the bottom surfaces of the weight rings 40, 70, 74 can also be provided with a rubberized coating which would provide additional friction between the floor or other surface to provide means for preventing rotation of the weight rings when the lock rings are being rotated for engagement or disengagement from the weight rings. Additionally, a rubber mat 82 may also be utilized as shown in FIG. 3 for providing this function. The first, second, and third lock rings 42, 72, and 76 can also be provided with a plurality of dimples 84 on an upper surface thereof in order to facilitate a user's gripping the lock rings for rotation relative to the weight rings.

With reference to FIGS. 17 through 19, a second preferred embodiment of first, second and third locking rings 42',72', 76' will be described in detail. As best seen in FIG. 17, a base weight member 14' is included. The base weight member 14' is identical in construction to the previously described base weight member 14, however, a tab portion 122 is further included running along selective lengths of upper angularly disposed edge portion 32'. The first locking ring 42' comprises first and second ring halves 124,126 which are pivotably attached to the first weight ring 40 by a hinge 128. This is best seen in FIG. 17*a*. Because the locking ring 42' is attached to the weight ring 40, the overall system becomes simpler by removing any concern a user may have for keeping track of the location of the locking ring 42'. The locking ring 42' is always with its respective weight ring. Each of the first and second ring halves 124,126 include a grooved portion 128 running along an angularly disposed inner surface 130 and a tab portion 134 running along an angularly disposed outer surface 132. In an open position, the first locking ring 42' is set over the first weight ring 40. The first locking ring 42' is then hinged into a closed position, such that first and second ring halves 124,126 come together. In a first preferred embodiment, the first and second ring halves 124,126 are held together by a latch mechanism 136. Latch mechanism 136 comprises a simple latch 138 hingable on the angularly disposed outer surface 132. The latch 138 is attached on the first half 124 and mates with a groove 140 on the second half. Once latched, the latch 138 is flush with the outer surface 132 such that subsequent locking rings are not obstructed. The grooved portion 128 of the first locking ring 42' mates with the tab portion 122 of base weight member 14'. In this manner, the groove portion 128 and the tab portion 122 act to prevent removal of the first locking ring 42' enabling the first locking ring 42' to retain the first weight ring 40 in position. The weight ring 40 also includes a plurality of fingers 40*a*' which extend from the inner edge thereof and which engage slots 42*a*' disposed in the inner surface of the locking ring 42'.

A second locking ring 72' is also included and is equivalent in construction to first locking ring 42' but is of a larger diameter. As such, a detailed description of the second locking ring 72' is not required. Similarly to the first locking ring 42', the second locking ring 72' is pivotally attached to the second weight ring 70. In an open position, the second locking ring 72' is set over the second weight ring 70. The second locking ring 72' is then hinged into a closed position and latched similarly to the first locking ring 42'. A groove portion 142 of the second locking ring 72' mates with the tab portion 134 of the first locking ring 72' to retain the second weight ring 70 in position around the first weight ring 40.

FIG. 19 shows a third locking ring 76' which is similar in construction to the first and second locking rings 42',72'. The third locking ring 76' is of a larger diameter than the second locking ring 72' such that it can fit around the second locking ring 72'. Similarly to the first and second locking rings 42',72', the third locking ring 76' is attached to the third weight ring 74. The third locking ring 76' maintains an upper angularly disposed edge portion 144 without a protruding tab portion. The third locking ring 76' comprises first and second ring halves 146,148 hingedly attached to one another by a hinge 150. Each of the first and second ring halves 146,148 include a grooved portion 152 running along an angularly disposed inner surface 153. In an open position, the third locking ring 76' is set over the third weight ring 74. The third locking ring 76' is then hinged into a closed position and latched similarly to the first and second locking rings 42',72'. The grooved portion 152 of the third locking ring 76' mates with a tab portion 154 of second locking ring 72'. In this manner, the grooved portion 152 and the tab portion 154 act to prevent removal of the third locking ring 76' enabling the third locking ring 76' to retain the third weight ring 74.

With reference to FIGS. 20 and 21, a second preferred embodiment of a locking ring latch mechanism 136 will be described in detail. The first half of the first locking ring maintains a recessed portion 160. A latch 162 is hingably attached to the first half 124 by first and second pivot arms 164,166 and is pivotable about a pin 168. The latch 162 has an upper surface 170 which is flush with an upper surface 172 of the first locking ring 42'. A spring 174 is disposed between a bottom surface 176 of the latch 162 and the recessed portion 160. The spring 174 acts to pivotally bias the latch 162 upwards such that the latch 162 remains in a lock position. A second end of the latch includes a protruding hook portion 180. When the first locking ring 42' is in the closed position the second end of the latch 162 extends over a recessed portion 182 of the second half 126. The recessed portion 182 includes a step 184 such that the hook 180 engages the step 184 to hold the first locking ring 42' in the closed position. To open the first locking ring 42', an operator simply presses on the first end of the latch 162 against the biasing force of the spring 174. As such, the latch 162 pivots about the pin 168 and the second end of the latch 162 rotates upward. This action disengages the hook 180 from the step 184 and the first locking ring 42' is then able to be opened for removal. It should be noted that latch mechanism 136 is usable with each of the first, second and third locking rings 42',72',76'. Therefore, although the first locking ring 42' has been used to detail the latch mechanism 136, it should be understood that this is merely an exemplary implementation and does not limit the use of latch mechanism 136 to the first locking ring 42'. It should also be noted that although the locking rings 42', 72', and 76' have been shown of a two-piece construction, a single piece flexible construction could also be utilized.

It should be noted that although the dumbbell assembly 10 of the present invention has been illustrated as a ring-shaped design, other shapes may be utilized without departing from the spirit and scope of the present invention. In particular, oval, square, or rectangular shaped members could be utilized in a similar nested fashion with different types of mating portions being required on the locking members for securing the additional weights to the base weight member. In addition, the above example was illustrated with three weight ring assemblies being added. It should be understood that any number of weight ring assemblies can be utilized so long as the size of the dumbbell system does not become too large and cumbersome for the user.

In older to provide even greater versatility with the dumbbell system of the present invention, a universal component may also be introduced to a single master member in order to provide for the addition of, for example, five-pound increments. This can be accomplished, for example, by providing a single heavier weighted lock ring to replace the innermost lock ring 42 which is lighter weight and made of plastic. The heavier weighted lock ring can be made of, or filled with, a heavier material than the lock ring 42. Alternatively, other methods of mounting an additional weight may be utilized.

The nested arrangement of the weight system of the present invention can also be utilized for providing variable weight disks 100 (shown in FIG. 10) for use with a standard barbell in the same manner that conventional weight disks are utilized. In this arrangement, the base weight member 102 is provided with a smaller central hole 104 which is adapted to receive a barbell therethrough. The first, second, and third weight ring assemblies 20, 22, 24 are removably mounted to the base weight member 102 in the same manner as described above with respect to the dumbbell system 10 or as described with respect to the embodiments of FIGS. 17–21 or FIGS. 25–29. Thus, the disk weight assembly 100, provides a compact design to provide several increments of weight in the space of a single disk.

Figure 23:
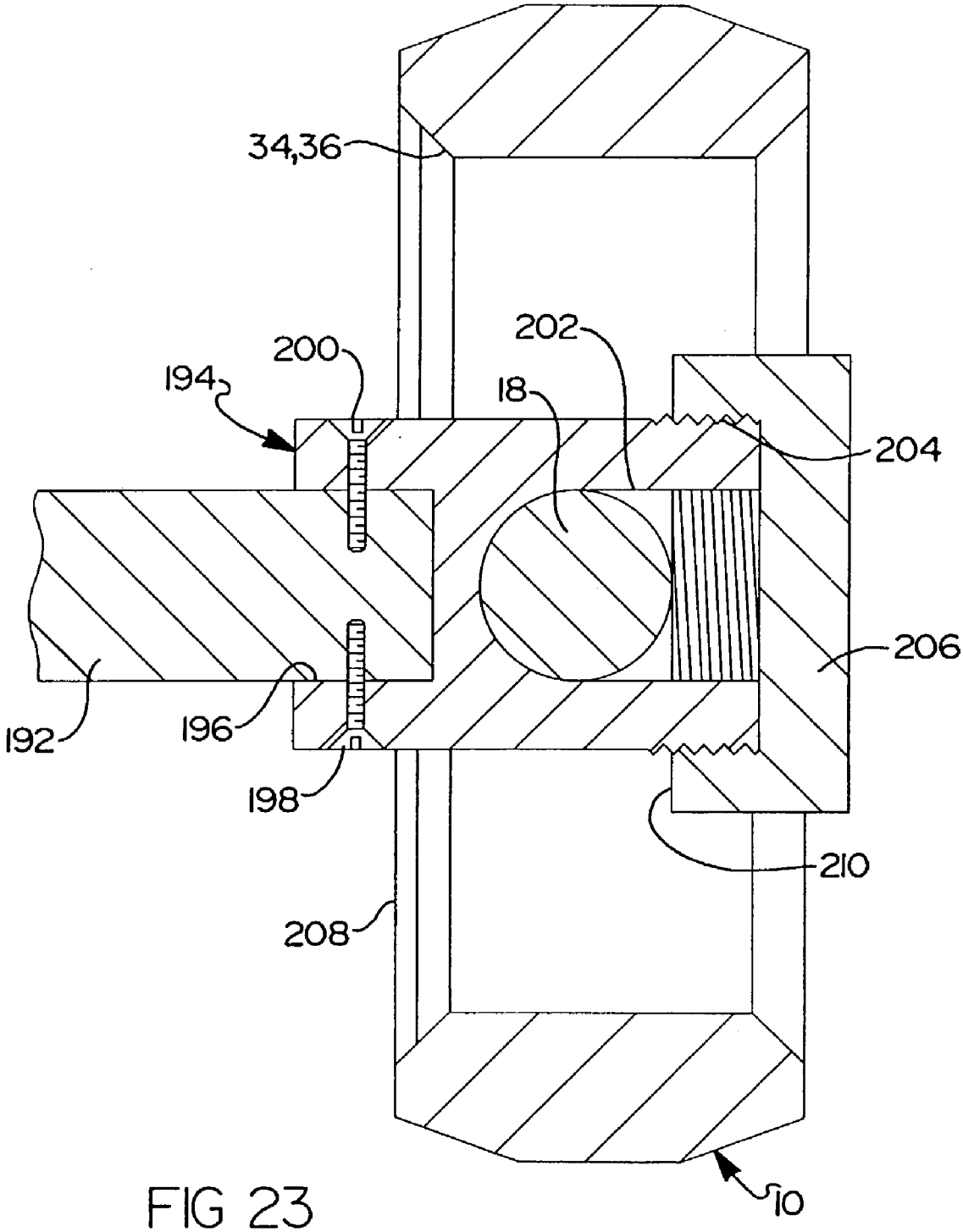
FIG. 23 is a cross-sectional view of the barbell assembly along line 23—23 of FIG. 22 illustrating an attachment mechanism for the dumbbell according to the principles of the present invention.
Figure 24:
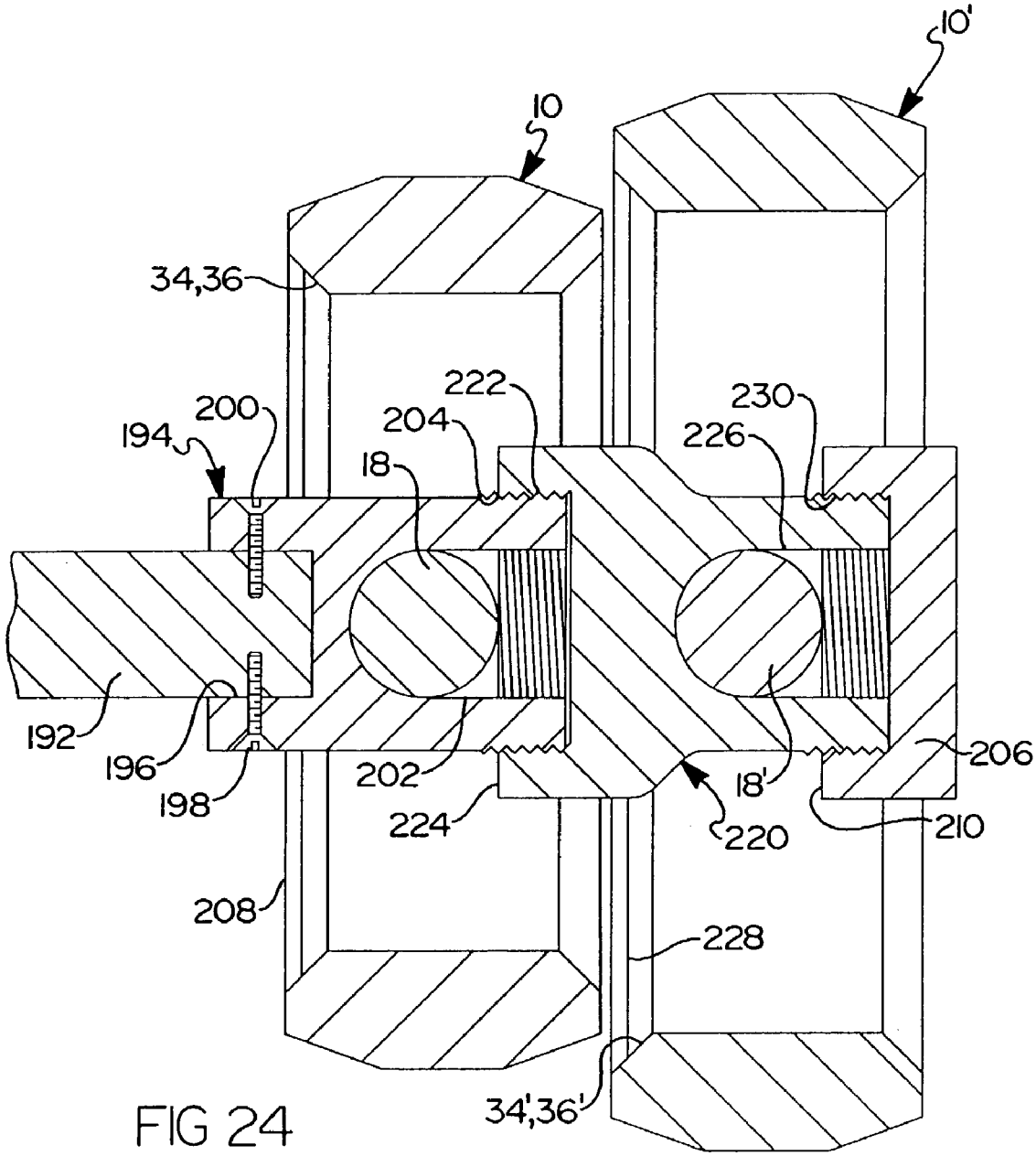
FIG. 24 is a cross-sectional view of the barbell assembly illustrating a second preferred method of attaching dumbbells for forming the barbell assembly.
Figure 25:
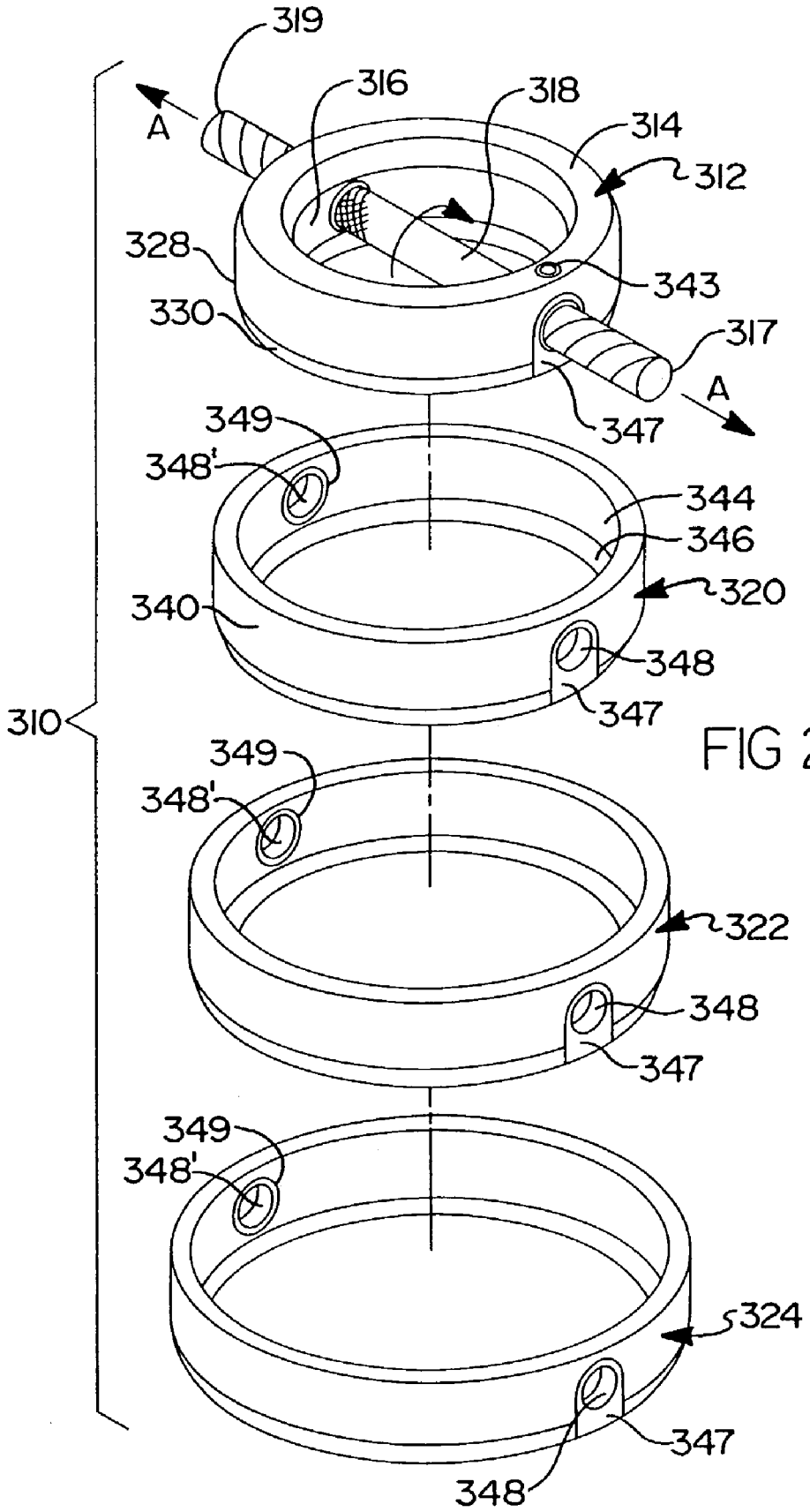
FIG. 25 is an exploded perspective view of a third embodiment of the dumbbell assembly according to the principles of the present invention.

With reference to FIGS. 22 through 24, a second preferred embodiment for a barbell will be described in detail. The barbell 190 comprises a bar 192 and first and second dumbbell assemblies 10, as described above (or alternatively the dumbbell assemblies of FIGS. 17–21 or FIGS. 25–29). The bar includes an adapter 194 disposed on each end. The adapter 194 includes a first recess 196 for receiving the bar 192 therein. First and second set screws 198,200 are used to hold the adapter 194 on the bar 192. The adapter 194 also includes a second U-shaped recess 202 for receiving the handle 18 of the dumbbell assembly 10 therein. The adapter 194 further includes a threaded portion 204 for threadably engaging a retention nut 206. A support disk 208 is fixed to and radially extends from the adapter 194 and is equivalent in diameter and angle as angularly disposed edge portions 34, 36 of dumbbell assembly 10. The dumbbell assembly 10 is mounted onto the adapter 194 by setting the handle 18 into the recess 202. The angularly disposed edge portion 34, 36 is supported by the support disk 208 preventing the dumbbell assembly 10 from pivoting about the handle 18 in the recess 202. The retention nut 206 is threaded onto the threaded portion 204 of the adapter 194 such that a bottom face 210 of the retention nut 206 contacts and puts pressure on the handle 18, within the recess 202.

With particular reference to FIG. 24, a second adapter 220 is shown which enables an increased amount of weight to be included on the barbell 190. After a first dumbbell assembly 10 has been mounted onto the barbell 190, the second adapter 220 is threaded onto the first adapter 194 in place of the retention nut 206. The second adapter 220 includes a first threaded portion 222, for engaging the threaded portion 204 of the first adapter 194. As the second adapter 220 is threaded onto the first adapter 194, a bottom face 224 of the second adapter 220 contacts the handle 18 for holding the handle 18 within the recess 202. The second adapter 220 further includes a recess 226 for receiving a handle 18' of a second dumbbell assembly 10'. A second support disk 228 is fixed to and radially extends from the second adapter 220, the end of which is equivalent in both diameter and angle of angularly disposed edge 34', 36'. Similarly to the first support disk 208, the second support disk 228 prevents the dumbbell assembly 10' from pivoting about the handle 18' in the recess 226. A second threaded portion 230 is also included which is identical in diameter and thread definition as is the threaded portion 204 of first adapter 194. As such, the retention nut 206 can be used to hold the handle 18' within the recess 226 of second adapter 220. Although the above-described embodiment has been disclosed with a threaded retention nut 206, it should be understood that a spring-type clamp, as is known in the art, may also be utilized to retain the dumbbell 10 to the adapter 194 and/or 220.

With reference to FIGS. 25 through 28, a third preferred embodiment of a dumbbell assembly 310, being similar in concept to dumbbell assembly 10, will be described in detail. The dumbbell assembly 310 includes a base weight member 312 including a body portion 314 defining a central opening 316 extending therethrough, a handle 318 which extends across the opening 316 in the body portion 314 and a pair of half shafts 317 and 319 for operatively securing additional weight rings. According to a preferred embodiment, the body portion 314 is substantially ring shaped. The ring shape can be cylindrical, oval, rectangular, or square. A first weight ring 320 is removably mounted to the base weight member 312. A second weight ring 322 is adapted to be removably mounted to the first weight ring 320. A third weight ring 324 is adapted to be removably mounted to the second weight ring 322.

Figure 28:
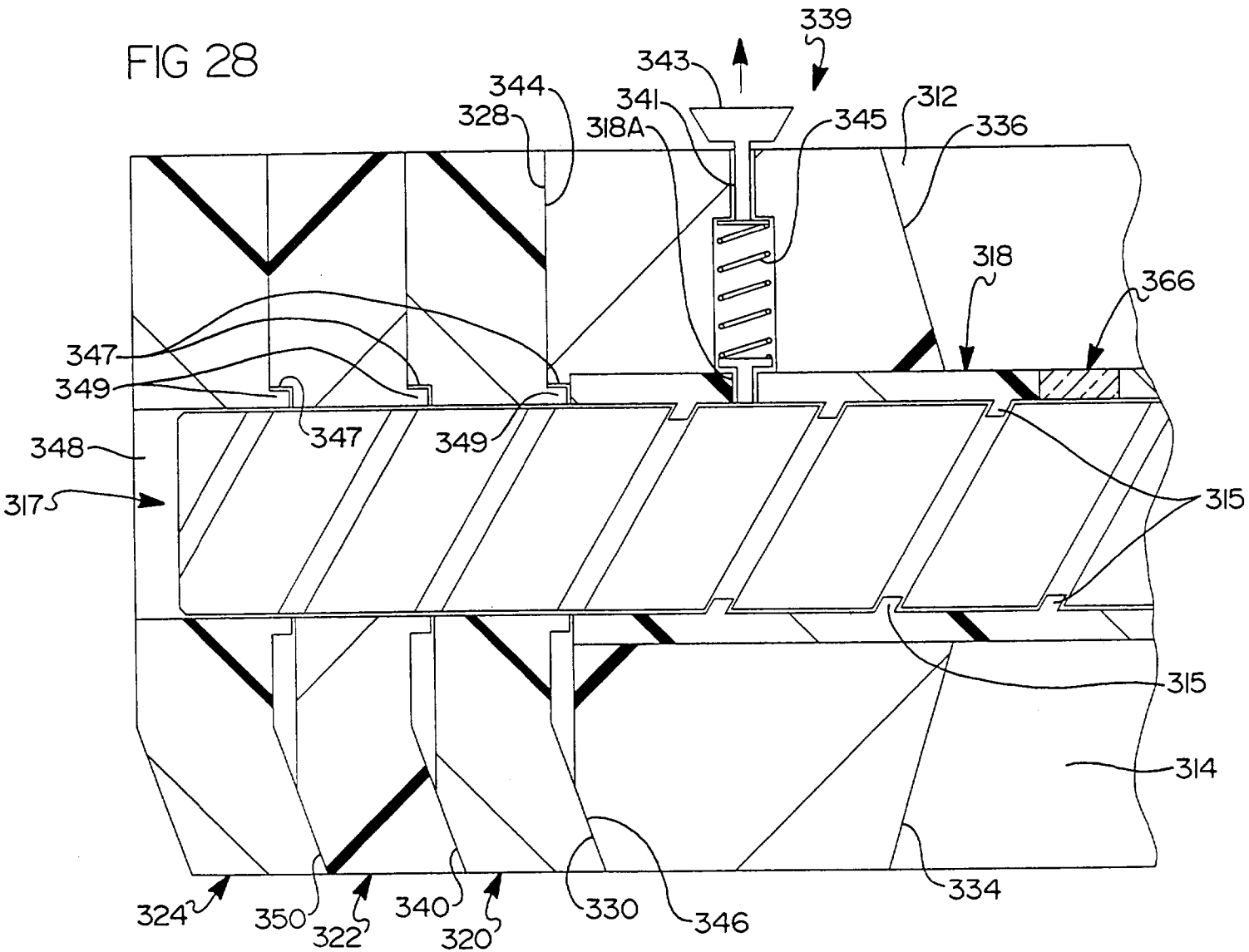
FIG. 28 is a cross sectional view of the dumbbell assembly taken along line 28—28 of FIG. 26 illustrating the threaded screw attachment mechanism for the addition of weight rings to the base weight member of the dumbbell assembly.

The pair of half shafts 317 and 319 are provided to secure additional weight rings to the base weight member 312. Handle 318 is constructed in a tubular shape and is rotatably attached to body portion 314 at two points in a diametrical configuration. As best shown in FIG. 28, handle 318 contains internal drive threads 315 extending from the inner surface thereof. Half shafts 317 and 319 include external threads 317*a*, 319*a* that are complementary to the threads 315. However, threads 317*a*, 319*a* on half shafts 317 and 319 are oppositely arranged. The threads 317*a* on shaft 317 are forward, right-hand, threaded and the threads 319*a* on shaft 319 are reverse, left hand, threaded. Additionally, as best shown in FIG. 27, each half shaft includes a keyway 321 that runs the length of the half shaft. Keyway 321 is engaged by key 323 which protrudes from body member 314 to prevent rotation of the half shafts 317 and 319.

As mentioned above, the body portion 314 of the base weight member 312 is preferably ring shaped. As best shown in the cross-sectional view of FIG. 28, the body portion 314 of the base weight member 312 includes an outer perimeter surface 328 with an angularly disposed edge 330 on the lower portion of surface 328. The angularly disposed edge 330 extends radially inward. It should also be noted that the inner perimeter surface of the body portion 314 is also provided with angularly disposed edge portions 334, 336 which extend radially outward and are identical in shape and function to edges 34 and 36 of body 14.

The base weight member 312 can be nested with a plurality of weight rings such as weight rings 320, 322, 324. The first weight ring 320 is a unitary construction having a ring shaped main body portion 340. The ring shaped body portion 340 includes an inner surface 344 with an angularly disposed edge portion 346 which extends radially inward and corresponds with the angularly disposed edge portion 330 of the base weight member 312. The first weight ring 320 also includes mounting holes 348 and 348' disposed therethrough located on diametrically opposed sides of ring shaped body portion 340. Mounting holes 348 and 348' are oriented generally perpendicular to inner surface 344 having a diameter sufficient to accommodate half-shafts 317 and 319.

To secure weight ring 320 to base weight member 312 for increasing the weight of dumbbell assembly 310 it is necessary to place base weight member 312 inside of weight ring 320 such that outer surface 328 of base weight member 312 and inner surface 344 of first weight ring 320 are adjacent. Next, the ends of half shafts 317 and 319 must be aligned with mounting holes 348 and 348', respectively. To attach the first weight ring 320 to base weight member 312 the handle 318 is rotated. When handle 318 is rotated clockwise, internal drive threads 315 apply a torque, to the external threads, on the half shafts 317 and 319. The key 321 and keyway system 323 prevents the rotation of half shafts 317 and 319, thus forcing the torque applied through handle 318 to translate half shafts 317 and 319 outward, as illustrated by Arrows "A". Once the ends of half shafts 317 and 319 have been translated into the mounting holes 348 and 348' of the first weight ring 320, the weight ring 320 is attached to the base weight member 312. Additional weight rings 322, 324 may be added to the dumbbell assembly 310 by following the same method.

To decrease the weight of the dumbbell assembly 310, the handle 318 can be rotated in the opposite direction stated above. When handle 318 is rotated in the opposite direction, half shafts 317 and 319 are translated inward opposite to the direction of Arrows "A" and are selectively disengaged from the weight rings 320, 322, 324.

It is also preferred that the dumbbell assembly 310 include a lock mechanism 339 to prevent handle 318 from undesired rotation. Lock mechanism 339 is mounted atop base weight member 312 substantially aligned with handle 318. Lock mechanism 339 includes a locking pin 341 for retaining the handle 318 in one position to prevent inadvertent release of a weight ring during use. The locking pin 341 is disposed in a hole 315 in base member 312. The locking pin 341 has a first end engaging a hole 318A in the handle 318 and a second end provided with a knob 343. Knob 343 is generally cylindrical in shape and allows pin 341 to be easily actuated. Pin 341 is biased into the locked position by spring member 345. Spring 345 is disposed around locking pin 341 and provides a biasing force that biases the locking pin 341 toward engagement with the handle 318. The operation of lock mechanism 339 is very simple. In order to rotate handle 318, knob 343 is pulled away from body portion 314 so that the locking pin 341 is disengaged with the handle 318. The handle 318 can then be rotated to drive the half shafts inward or outward. The lock mechanism 339 self engages when the handle 318 is turned until spring member 345 forces pin 341 to snap into hole 318A on handle 318. As the pin 341 snaps into the hole 318A, it provides an acoustic and a visual lock signal to the user.

Additionally located along the outer surface of the base weight member and outer surfaces of the weight rings is a U-shaped slot 347 for helping to line up the weight rings. The slot corresponds to a boss 349 that is positioned on the inner surface of each of the weight rings 320. As the base weight member 312 is positioned within the first weight ring 320, the slot 347 receives the boss 349 to prevent misalignment and guides the base weight member 312 such that mounting holes 348 and 348' and half shafts 317 and 319 are aligned. In the present embodiment, slots 347 and boss 349 are located around the mounting holes 348, 348'. It is, however, understood that alternative positioning of the slot 347 and boss 349 would accomplish the same function as the position of the present slots and bosses.

The handle 318 is optionally provided with at least one or a plurality of indicator windows 360, 362, 364, 366 which are magnified to magnify a weight identification number disposed on the top of a thread surface of one or both of the half shafts 317, 319. The location of the window or windows are arranged such that numbers, e.g. "20," "30," "40," "50," are shown through a window 360, 362, 364, 366, respectively, when the half shafts are in the appropriate position for engaging a selected weight increment. As shown in FIG. 26, the number "40" is shown in window 364 to indicate to the user that, for example, two weight rings 320, 322 are engaged with the base weight member 312 to provide a forty-pound dumbbell. The pitch of the threads on the half shafts 317, 319 dictate where the windows 360, 362, 364, 366 are located and the number of windows necessary. It is possible with the appropriate pitch thread that a single window could be utilized to display the weight increment values. The numbers representative of the weight increments can also be color coded to match the color of the desired ring or rings that are to be engaged with the base weight member. Also, the pitch of the threads on the half shafts can also be selected to allow for the handle 318 to be rotated in either a full rotation or partial rotation (i.e., 90°, 120°, 180°) for engaging additional weight rings. In the case of partial rotations being utilized, additional holes 318*a* are needed to be spaced around the handle 318 to be engaged by the locking pin 341 at the various desired locations for providing full engagement with the desired weight ring 320, 322, 324.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dumbbell system, comprising:

a base weight member having a body portion with an generally round opening disposed therethrough;

a second weight member adapted to be removably mounted to said base weight member;

a handle extending across the opening in said body portion, said handle being rotatably supported on opposite ends thereof by said body portion;

a locking member operably engaged with said handle for extending outward from said base weight member for removably attaching said second weight member to said base weight member.

2. The dumbbell system according to claim 1, further comprising a second locking member operably engaged with said handle for extending outward from said base weight member for removably attaching said second member to said base weight member.

3. The dumbbell system according to claim 1, further comprising a lock mechanism engageable with said handle to prevent rotation of said handle.

4. The dumbbell system according to claim 3, wherein said lock mechanism includes:

a pin extending downward within a hole in said base weight member;

a knob attached to said pin for operating said lock mechanism; and a spring for biasing said pin toward an engaged position with said handle.

5. The dumbbell system according to claim 1, further comprising a display mechanism on said handle for displaying an engagement status of said locking member.

6. The dumbbell system according to claim 5, wherein said display mechanism includes a window in said handle and a reference indicator viewable through said window to indicate when said second weight member is engaged with said base weight member.

* * * * *